US005615810A

United States Patent [19]

Kolton et al.

[11] Patent Number: 5,615,810

[45] Date of Patent: Apr. 1, 1997

[54] HANGER FOR SUSPENDERS WITH TROUSER WAISTBAND SNAPS

[75] Inventors: Chester Kolton, Westfield; Stuart S. Spater, Livingston, both of N.J.

[73] Assignee: B&G Plastics, Inc., Newark, N.J.

[21] Appl. No.: 583,944

[22] Filed: Jan. 11, 1996

[51] Int. Cl.[6] ..... A47G 25/34; A47G 25/14

[52] U.S. Cl. ..... 223/85; 223/87; 223/DIG. 1

[58] Field of Search ..... 223/85, 87, DIG. 1, 223/88, 94, 89; D6/315

[56] References Cited

U.S. PATENT DOCUMENTS

| | | | |
|---|---|---|---|
| D. 93,143 | 8/1934 | Spragg | 223/DIG. 1 |
| D. 195,017 | 4/1963 | Wilhelm | 223/DIG. 1 |
| 3,755,859 | 9/1973 | Solari | 223/87 |
| 3,790,045 | 2/1974 | Rigel et al. | 223/87 |
| 5,222,638 | 6/1993 | Kolton et al. | 223/DIG. 1 |
| 5,429,284 | 7/1995 | Kolton et al. | 223/DIG. 1 |

FOREIGN PATENT DOCUMENTS

| | | | |
|---|---|---|---|
| 2551090 | 5/1977 | Germany | 223/DIG. 1 |
| 310204 | 12/1955 | Switzerland | 223/DIG. 1 |

*Primary Examiner*—Bibhu Mohanty
*Attorney, Agent, or Firm*—Robin, Blecker, Daley & Driscoll

[57] ABSTRACT

A hanger is comprised of an elongate, one-piece body of plastic material, the hanger having a hook portion, a logo display portion, a main body portion having arms extending oppositely, horizontally therefrom to respective free ends for receipt of closed suspender snaps, and a retention member. A fold line segment is defined in the body below the main body portion and a flap member is defined in the body below the fold line segment. The retention member and the flap member have interfitting securement parts and define a sidewardly open, horizontal slot therebetween.

20 Claims, 4 Drawing Sheets

HANGER FOR SUSPENDERS WITH TROUSER WAISTBAND SNAPS

FIELD OF THE INVENTION

This invention relates generally to hangers for the hanging of suspenders and pertains more particularly to hangers for the hanging of suspenders of the type having snaps adapted to receive and retentively close upon a trouser waistband.

BACKGROUND OF THE INVENTION

Commonly-assigned U.S. Pat. Nos. 4,714,156 and 4,718,546 address the hanging of suspenders of the type having straps with slots therein for receiving buttons disposed interiorly on a trouser waistband. Another type of suspenders is quite widespread use and useful with trousers not having suspender-receiving buttons on its waistband. That suspenders type has straps equipped with snaps adapted to receive and retentively close upon the waistband of trousers.

A hanger for the hanging of suspenders of the snap variety is shown in commonly-assigned U.S. Pat. No. 4,759,440, which notes a problem attending such suspenders, namely, that the snaps need be closed at the point of manufacture, to avoid entanglement of the snaps with one another during shipment. The '440 patent provides a hanger adapted to receive suspenders with the snaps thereof in closed state and the hanger may be applied to the suspenders either at the point of manufacture and shipment.

A disadvantage of the '440 patent hanger lies in its solution to the above-described problem, i.e., suspenders may be readily removed from the hanger, giving rise to possible fraud by purchasers shifting more expensive suspenders to hangers bearing less expensive price indication.

SUMMARY OF THE INVENTION

The present invention has as its primary object the provision of hangers for the hanging of snap-type suspenders in snap-closed condition but nonetheless providing anti-fraud facility.

In attaining the foregoing and other objects, the invention provides a hanger comprised of an elongate, one-piece body of plastic material, the hanger having a hook portion, a logo display portion, a main body portion having arms extending oppositely, horizontally therefrom to respective free ends for receipt of closed suspender snaps, and a retention member. A fold line segment is defined in the body below the main body portion and a flap member is defined in the body below the fold line segment. The retention member and the flap member have interfitting securement parts and define a sidewardly open, horizontal slot therebetween.

In use of the hanger of the invention, a suspenders is applied to the hanger by inserting the main body portion arms through the closed snaps of the suspenders. The suspender straps are then inserted into the horizontal slot and the flap member is then folded about the fold line segment into registry with the retention member and the securement parts thereof are interfit. The securement parts are of a type which, once interfit, cannot be opened without cutting and disfiguring the hanger.

The foregoing and other objects and features of the invention will be further understood from the following detailed description of preferred embodiments thereof and from the drawings wherein like reference numerals identify like parts throughout.

DETAILED DESCRIPTION OF PREFERRED EMBODIMENTS AND PRACTICES

Figure 2:
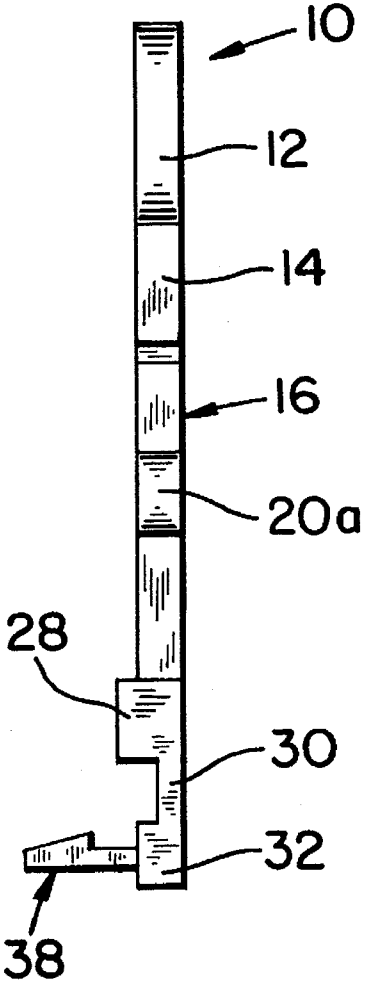
FIG. 2 is a right side elevation of the FIG. 1 hanger.
Figure 1:
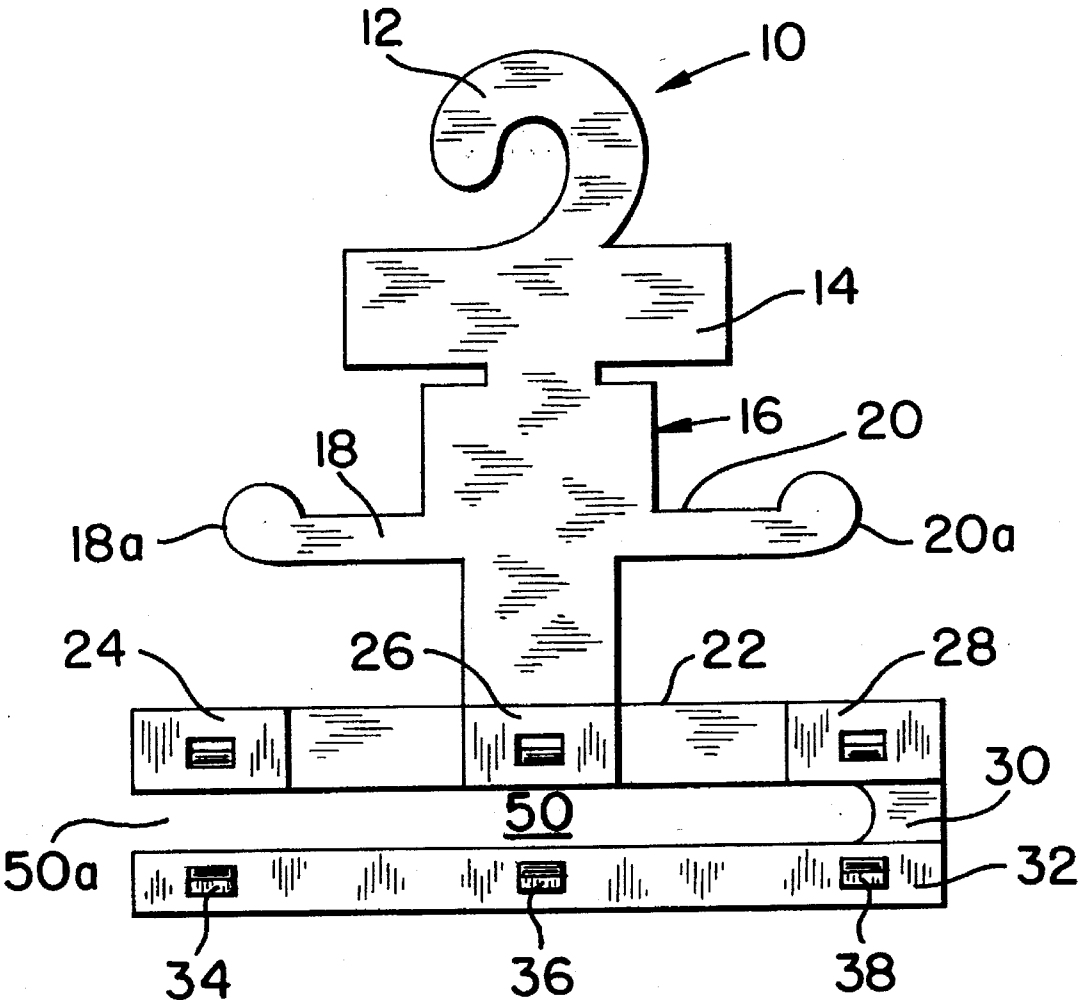
FIG. 1 is a front elevation of a hanger in accordance with the invention.

Referring to FIGS. 1 and 2, hanger 10 of the present invention is comprised of an elongate, one-piece body of plastic material, the hanger having a hook portion 12, a logo display portion 14 and a main body portion 16.

Main body portion 16 includes arms 18 and 20 extending oppositely, horizontally therefrom to respective free ends 18*a* and 20*a*. As illustrated, arms 18 and 20 have free spaces thereabove and therebelow, such that closed suspender snaps are readily receivable by insertion of the arms through the closed snaps, as discussed more particularly hereinafter.

Downwardly of arms 18 and 20, main body portion 16 defines retention member 22, which extends horizontally beyond the lateral extremities of arms 18 and 20 and which includes retention or securement structures 24, 26 and 28, also discussed more particularly hereinafter.

Downwardly of retention member 22, hanger 10 includes fold line segment 30, which has a lessened thickness than adjacent hanger extents.

Flap member 32 is defined in hanger 10 body below fold line segment 30 and has retention or securement structures 34, 36 and 38, also discussed more particularly hereinafter.

Figure 4:
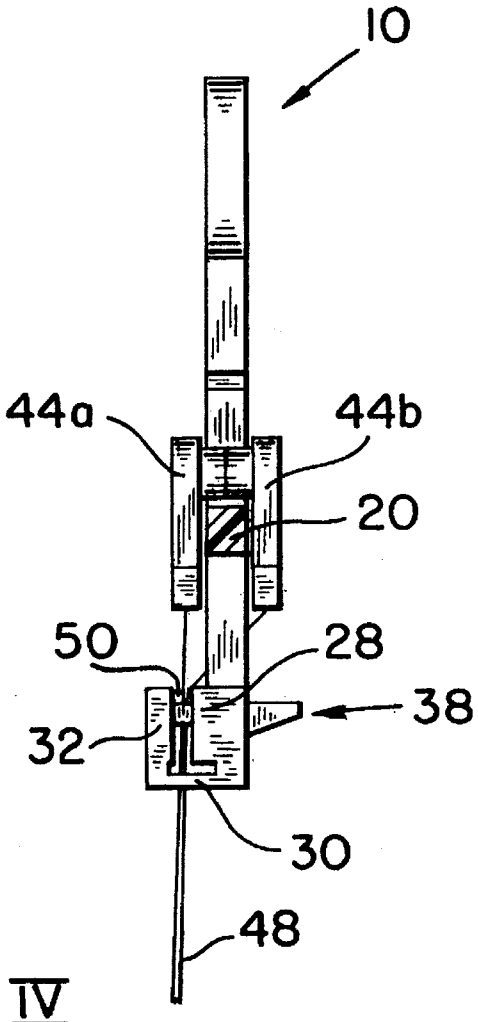
FIG. 4 is a sectional view as would be seen from plane IV—IV of FIG. 3.
Figure 3:
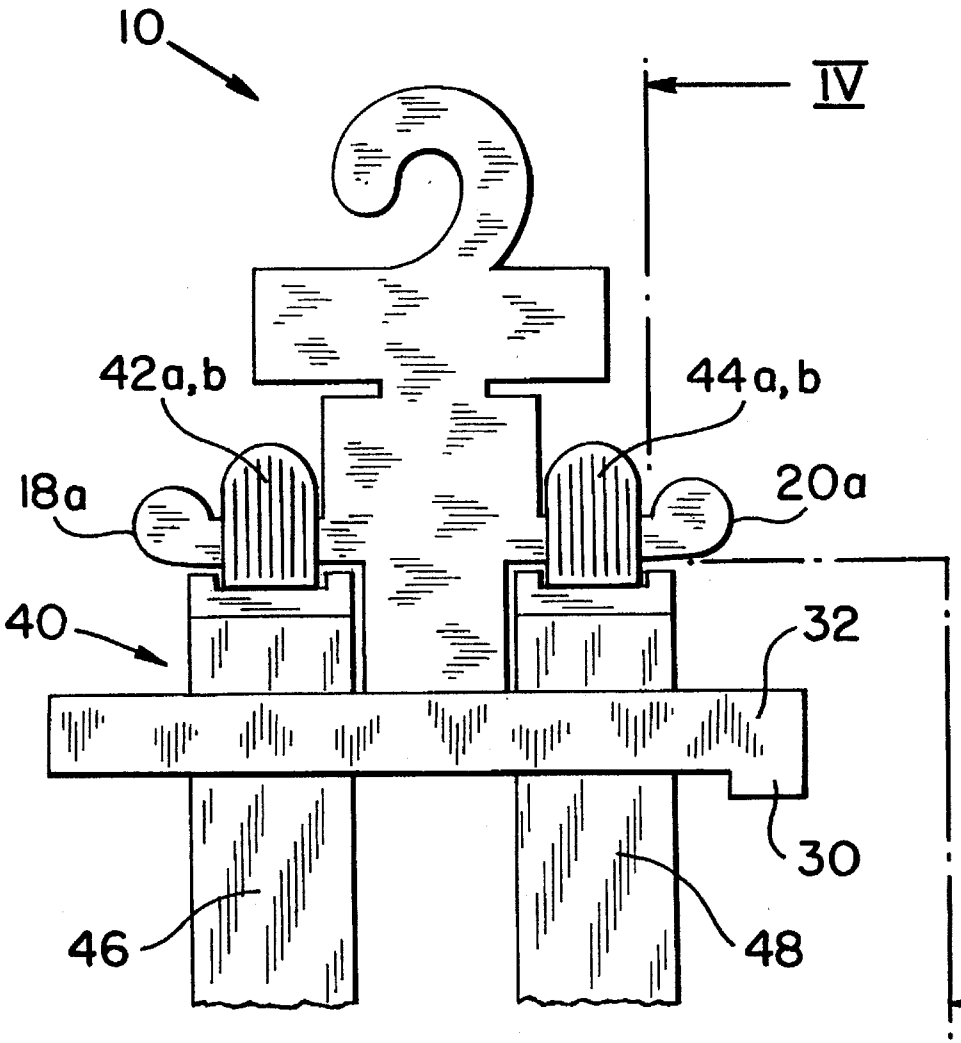
FIG. 3 is a front elevation of the FIG. 1 hanger shown in assembly with a suspenders.

Turning to FIGS. 3 and 4, hanger 10 is shown in assembly with suspenders 40, having snaps 42*a*, 42*b* and 44*a*, 44*b* and straps 46 and 48 associated therewith. In reaching the assembly of FIGS. 3 and 4, suspenders 40 is applied to hanger 10 initially by inserting main body portion arms 18 and 20 through the closed snaps 42*a*, 42*b* and 44*a*, 44*b* thereof. Straps 46 and 48 are now dressed into slot 50 (FIG. 1), which has open margin 50*a*, and extends horizontally to a closed end defined by fold line segment 30. At this juncture, flap member 32 is folded about fold line segment 30, into registry with retention member 22 and the securement parts thereof are interfit.

Figure 5:
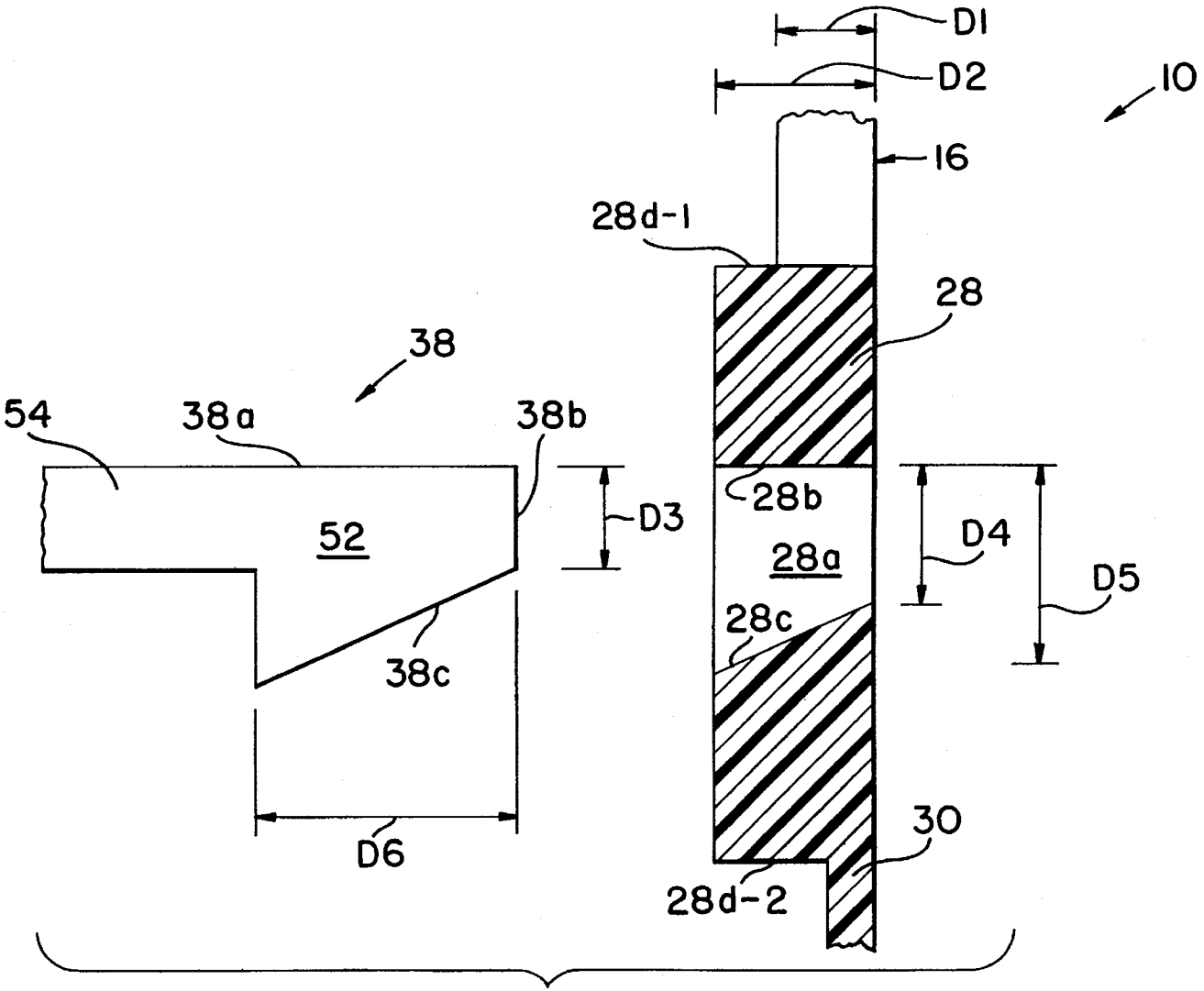
FIGS. 5, 6 and 7 are enlarged partial views depicting the retention structures of the hanger of FIG. 1.

Turning to FIG. 5, the rightward portion thereof depicts hanger 10 in part and in section. Main body portion 16 is of thickness D1. Securement part 28 has thickness D2, greater than D1, and defines a passage 28*a* therethrough, upwardly bounded by horizontal surface 28*b* and downwardly bounded by surface 28*c*, which is at an acute angle to surface 28*b*. Passage 28*a* has rightward height D4 and leftward height D5.

The leftward portion of FIG. 5 depicts hanger projection 38, having locking member 52 and shaft 54, the latter being of thickness D3 and the former being of extent D6. Projection 38 has horizontal surface 38*a*, vertical surface 38*b* and surface 38*c*, which is at an acute angle to surface 38*a*.

Locking member 52 is configured to be insertable in passage 28*a* upon folding of flap segment 32 about fold line segment 30 to retentively retain the flap member in folded condition.

Figure 7:
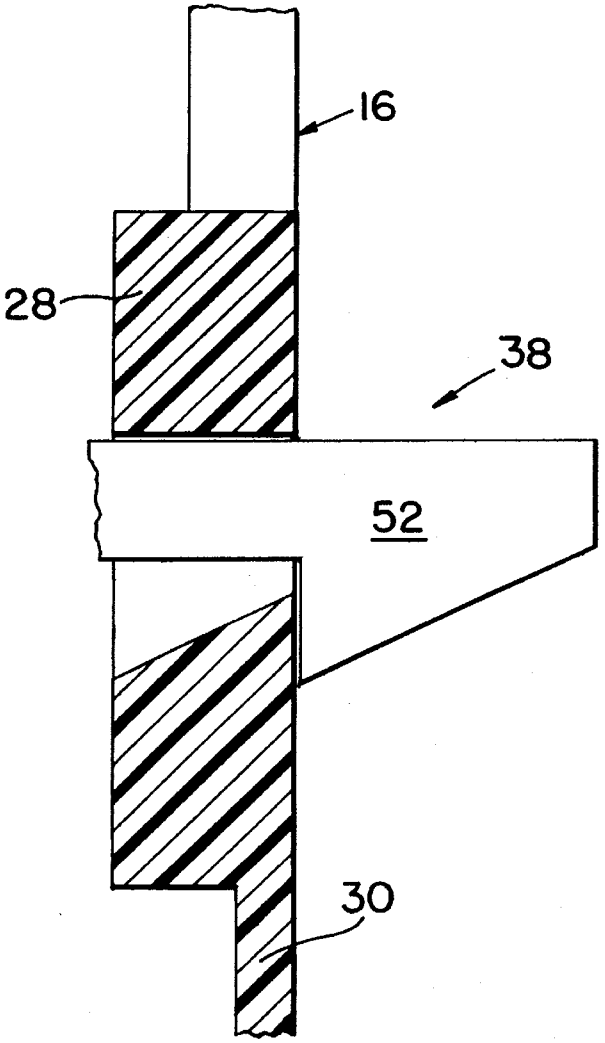
Figure 6:
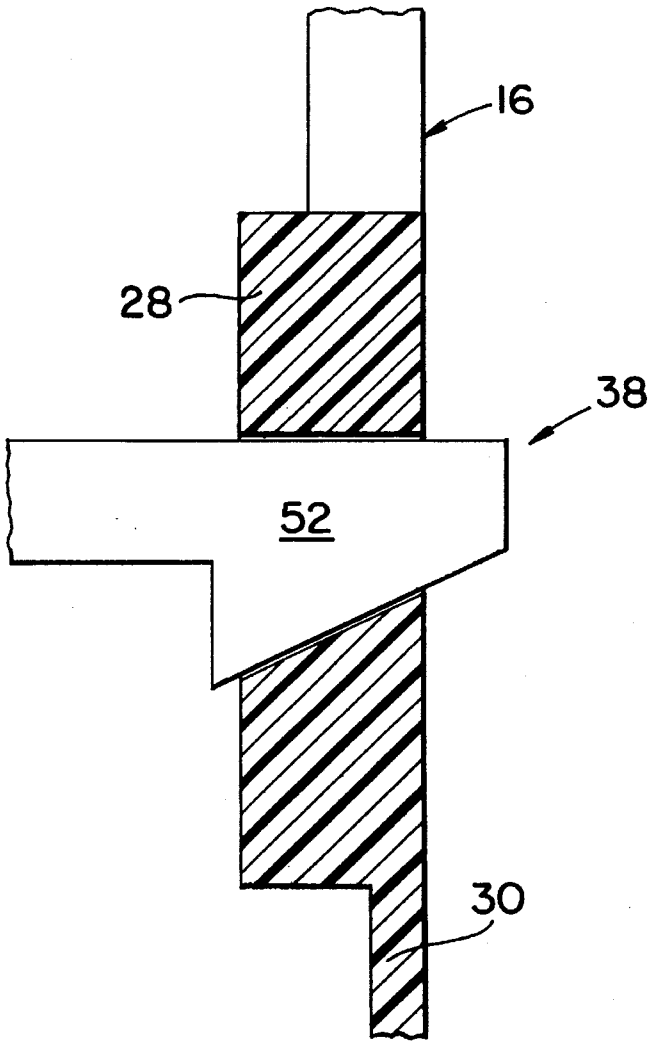

FIG. 6 depicts projection 38 in the course of insertion in passage 28*a* and FIG. 7 depicts the completed phase of insertion.

In reaching the FIG. 7 assembly, projection 38 is inserted into passage 28*a* and forced therethrough. In an initial phase of assembly, as shown in FIG. 6, the complemental configuration of the projection and the passage permits ready, friction-free insertion. Thereafter, the remnant of the projection, i.e., that portion thereof outwardly of the passage (of measure D6–D2) is wedged into the passage. In the course of wedging, retention part 28 expands to facilitate projection entry since it is not bounded by hanger material at its upper and lower limits 28*d*-1 and 28*d*-2.

Various changes to the particularly disclosed embodiment and practices may evidently be introduced without departing from the invention. By way of example, the illustrated latching structure is used for applications in which high security is desired and may be replaced with other latching structure in other applications. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A hanger comprised of an elongate, upstanding, one-piece body of plastic material, said hanger having a main body portion having arms extending oppositely therefrom to respective free ends, and having a retention member downwardly of said arms, a fold line segment below the main body portion and a flap member below the fold line segment, said retention member and said flap member having interfitting securement parts and defining a sidewardly and downwardly open, horizontal slot therebetween, said slot having open expanse downwardly of each of said main body portion arms.

2. The hanger claimed in claim 1, further including a hook portion upwardly of said main body portion.

3. The hanger claimed in claim 1, further including a logo display portion upwardly of said main body portion.

4. The hanger claimed in claim 3, further including a hook portion upwardly of said logo display portion.

5. The hanger claimed in claim 1, wherein said flap member extends horizontally outwardly of said main body portion arms.

6. The hanger claimed in claim 5, wherein said interfitting securement parts of said retention member and said flap member are each plural in number.

7. The hanger claimed in claim 6, wherein said interfitting securement parts are in first pairs horizontally outwardly of said free ends of said main body portion arms.

8. The hanger claimed in claim 7, wherein said interfitting securement parts include a further pair horizontally inwardly of said free ends of said main body portion arms.

9. In combination:

a hanger comprised of an elongate, upstanding, one-piece body of plastic material, said hanger having a main body portion having arms extending oppositely therefrom to respective free ends, and having a retention member downwardly of said arms, a fold line segment below the main body portion and a flap member below the fold line segment, said retention member and said flap member having interfitting securement parts and defining a sidewardly open, horizontal slot therebetween; and suspenders including closed snaps and straps depending from said snaps, said hanger arms extending through said closed snaps, said straps being disposed between said retention member and said flap member.

10. The invention claimed in claim 9, wherein said hanger further includes a hook portion upwardly of said main body portion.

11. The invention claimed in claim 9, wherein said hanger further includes a logo display portion upwardly of said main body portion.

12. The invention claimed in claim 11, wherein said hanger further includes a hook portion upwardly of said logo display portion.

13. The invention claimed in claim 9, wherein said flap member extends horizontally outwardly of said main body portion arms.

14. The invention claimed in claim 13, wherein said interfitting securement parts of said retention member and said flap member are each plural in number.

15. The invention claimed in claim 14, wherein said interfitting securement parts are in first pairs horizontally outwardly of said free ends of said main body portion arms.

16. The invention claimed in claim 15, wherein said interfitting securement parts include a further pair horizontally inwardly of said free ends of said main body portion arms.

17. A hanger comprised of an elongate, upstanding, one-piece body of plastic material, said hanger having a main body portion having arms extending oppositely therefrom to respective free ends, and having a retention member downwardly of said arms, a fold line segment below the main body portion and a flap member below the fold line segment, said retention member and said flap member having interfitting securement parts and said body defining a sidewardly open, horizontal slot therebetween, said slot extending to but not through said fold line segment.

18. The hanger claimed in claim 17, further including a hook portion upwardly of said main body portion.

19. The hanger claimed in claim 17, further including a logo display portion upwardly of said main body portion.

20. The hanger claimed in claim 17, wherein said flap member extends horizontally outwardly of said main body portion arms.

* * * * *